US005379540A

United States Patent [19]

Howard

[11] Patent Number: 5,379,540

[45] Date of Patent: Jan. 10, 1995

[54] MODULAR SIGN SYSTEM

[75] Inventor: Kent D. Howard, Dousman, Wis.

[73] Assignee: The Howard Company, Brookfield, Wis.

[21] Appl. No.: 154,045

[22] Filed: Nov. 17, 1993

[51] Int. Cl.[6] ..... G09F 13/04

[52] U.S. Cl. ..... 40/558; 40/573; 40/605; 362/226

[58] Field of Search ..... 40/573, 605, 558, 568, 40/574; 362/260, 225, 226, 249, 812; 403/381, 330, 409.1

[56] References Cited

U.S. PATENT DOCUMENTS

| | | | |
|---|---|---|---|
| 1,130,324 | 3/1915 | Owen | 403/381 X |
| 1,171,589 | 2/1916 | Brownfield | 403/381 |
| 1,701,378 | 2/1929 | Riviere | 40/573 |
| 1,965,916 | 7/1934 | Wise | 40/573 |
| 4,415,957 | 11/1983 | Schwartz | 362/226 X |
| 4,653,209 | 3/1987 | Cobb | 40/568 X |

OTHER PUBLICATIONS

"Instructions For Assembly of Your Mainstreet Menu System", pubished by The Howard Company.

"Panelon Menuboard System", copyright 1986 by Posterloid Corporation.

Visual Marketing Associates brochure entitled, "Introducing: Broadway Menu Display Systems," copyright 1991.

"Posterloid Panorama Menuboard System," Posterloid Corporation, copyright 1986.

"Panel-Lite Menu Board Series," American Menu Displays, copyright 1990.

*Primary Examiner*—Peter R. Brown
*Assistant Examiner*—Joanne Silbermann
*Attorney, Agent, or Firm*—Quarles & Brady

[57] ABSTRACT

A sign assembly can be formed by attaching several modules together. Each module includes a lamp assembly for back lighting the sign display, and has walls with a plurality of dovetail grooves in their exterior surfaces. Double dovetail unions engage the dovetail grooves in abutting walls of a pair of modules to fasten those modules together. Other dovetail unions fill in exposed grooves or fasten a frame around the perimeter of the sign assembly. Each module has a wiring assembly with connectors at each corner so that adjoining modules can be electrically interconnected. This enables electricity to be externally applied to only one module of the assembly with the other modules receiving electricity directly or indirectly from that one module.

19 Claims, 4 Drawing Sheets

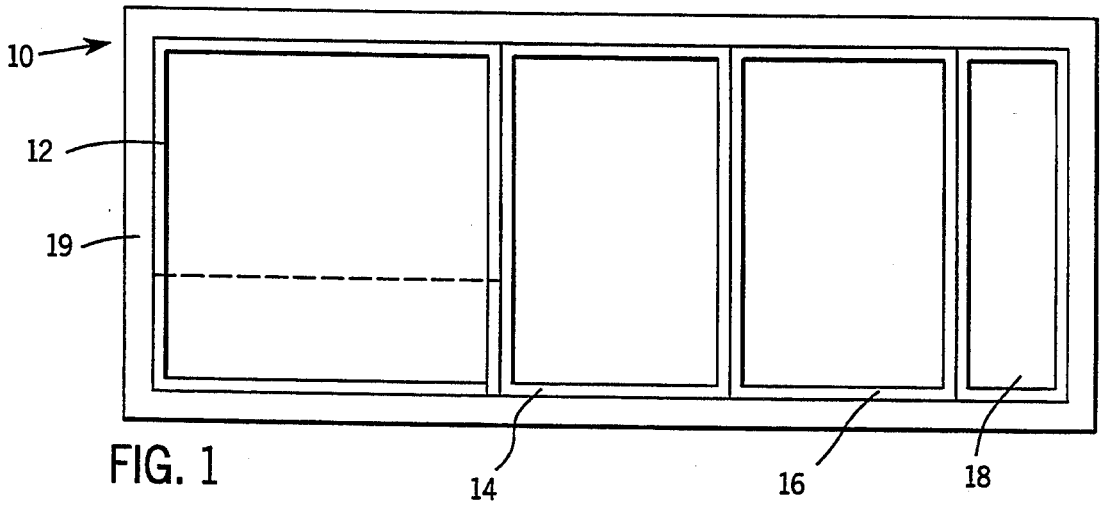
FIG. 1
FIG. 6
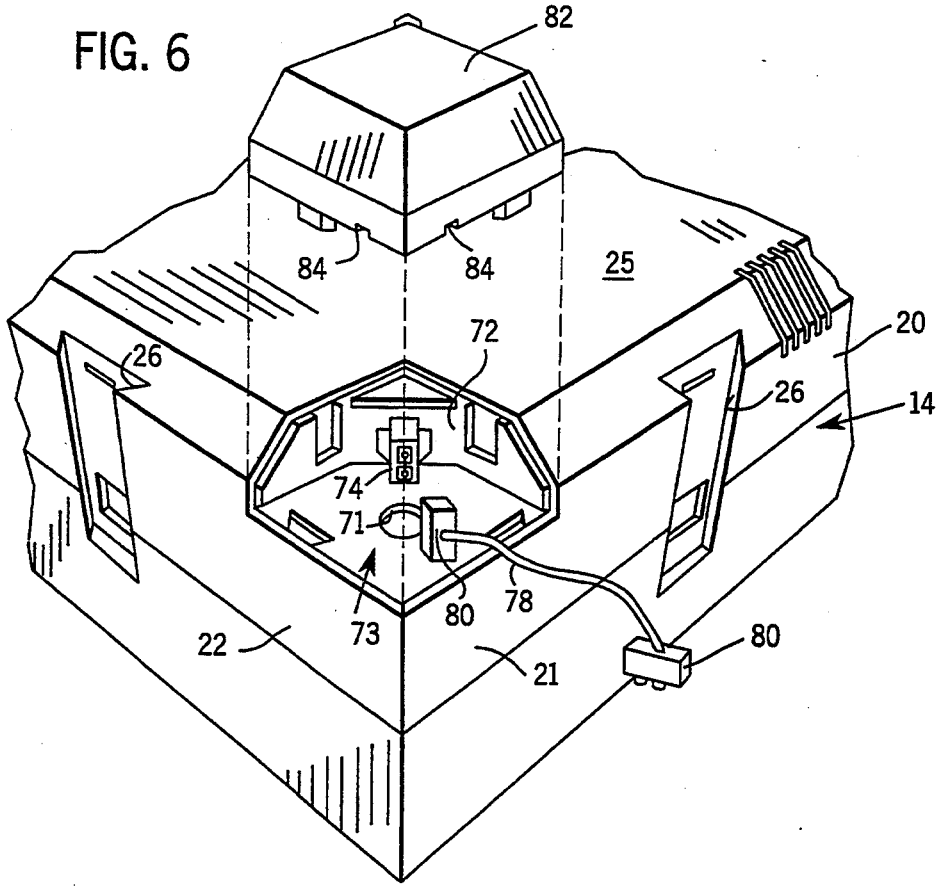

FIG. 3A
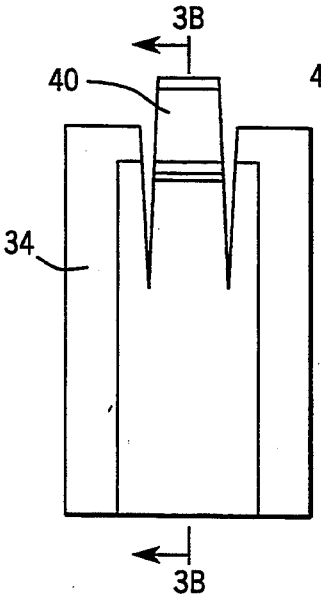
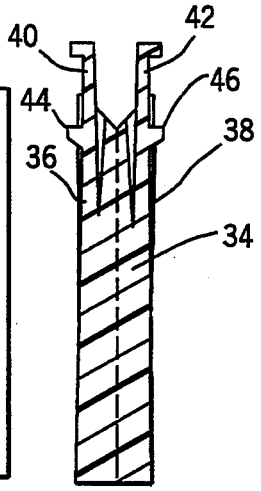
FIG. 3B
FIG. 4A
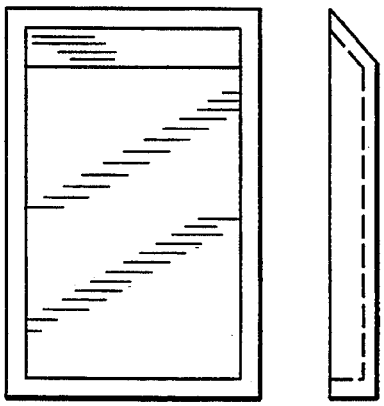
FIG. 4B
FIG. 5A
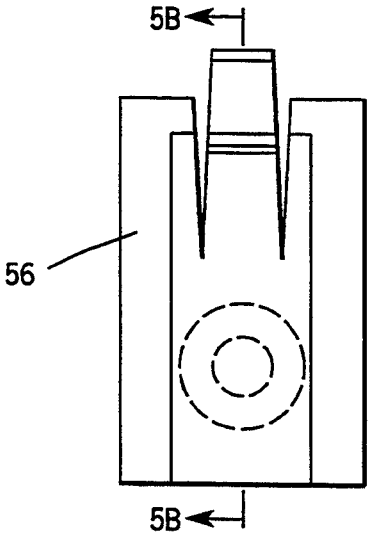
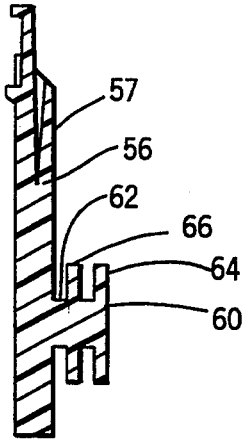
FIG. 5B

MODULAR SIGN SYSTEM

BACKGROUND OF THE INVENTION

The present invention relates to back lighted display signs, and more particularly to such signs which are formed by modules that can be combined side-by-side to form a wide variety of different sized and shaped sign assemblies.

Above a counter in fast food restaurants, there is often a large sign presenting the menu and prices of food items offered for sale. Typically, these signs consist of a number of panels with each panel displaying a different category of items. For example, one panel may list hot sandwiches, with another panel for cold sandwiches, and yet another panel listing beverages and desserts. A panel may also display a photographic reproduction of a food item being offered for sale as a way in which to create customer interest. Quite often these signs are back lit with the lettering and photographic image being translucent to emit light.

Because the display area varies from restaurant to restaurant, and because of a need to create a distinctive appearing sign for various restaurants, modular sign systems have been devised. Previously, such signs were created by side-by-side combinations of a number of square modules having a frame which contain light bulbs over which a translucent message panel was mounted. Such square units could be combined in horizontal and vertical lines, or in a two-dimensional array to form different sized and shaped sign assemblies.

Often, the individual modules of the sign assembly had to be attached together so that the entire display could be suspended from a ceiling or mounted in some other fashion as a single unit. It is therefore desirable to provide a mechanism by which the different modules can be attached to one another without visible fastening mechanisms or the need for special tools. Furthermore, since each module contains its own lamp assembly, a mechanism for supplying electrical current to each module has to be provided. It is undesirable to have a separate external cord for each module as the number of such cords because of the numerous cords that would extend from a large sign assembly. It is also desirable to provide a mechanism by which a trim frame can be attached around the perimeter of the assembled sign in order to create a decorative appearance to the overall sign and set it apart from its surroundings.

SUMMARY OF THE INVENTION

A general object of the present invention is to provide a modular sign system in which a plurality of modules can be interconnected in one or two dimensional arrays to form a sign assembly.

To accomplish that objective each module has a base that includes a plurality of walls attached to and extending from a base panel. Each wall has at least one dovetail groove in an exterior surface. A lamp tray containing at least one light bulb is located within the walls of the base. A bezel extends over the lamp tray and abuts the base walls. The bezel also has walls which have dovetail grooves, each of which aligns with a similar dovetail groove in the base.

A separate dovetail union is positioned in each dovetail groove in the base and extends into the associated dovetail groove in the bezel. When two of these modules are placed side-by-side, double dovetail unions are inserted into the grooves in the abutting walls of the two modules to secure the modules together. Single dovetail unions are used to fill in the dovetail grooves on exposed walls of a module. Another type of dovetail union has a mechanism for fastening an optional decorative frame around the perimeter of one or more assembled modules.

The preferred version of the module has a wiring assembly with electrical connectors located at each corner of the module. When several modules are combined into a sign assembly, cables couple the corner connectors of adjacent modules. This interconnection of the modules enables an external electrical power connection to be made to only one module in the assembly with the other modules receiving power from that One module.

Another feature of the present modular sign concept is a mechanism by which components of two rectangular modules can be combined to form a square module or a larger rectangular module.

BRIEF DESCRIPTION OF THE DRAWINGS

FIG. 1 is a plane view of a modular sign assembly according to the present invention;

FIGS. 3A and 3B illustrate a double dovetail connector used to join two modules;

FIGS. 4A and 4B illustrate a single dovetail connector used on exposed edges of a module; and FIGS. 5A and 5B depict a single dovetail connector having a post for fastening a trim frame on an outer edge of the sign assembly;

FIG. 6 is an enlargement of a corner of the underside of the frame in FIG. 2 showing the electrical connections between modules.

DETAILED DESCRIPTION OF THE INVENTION

Figure 2:
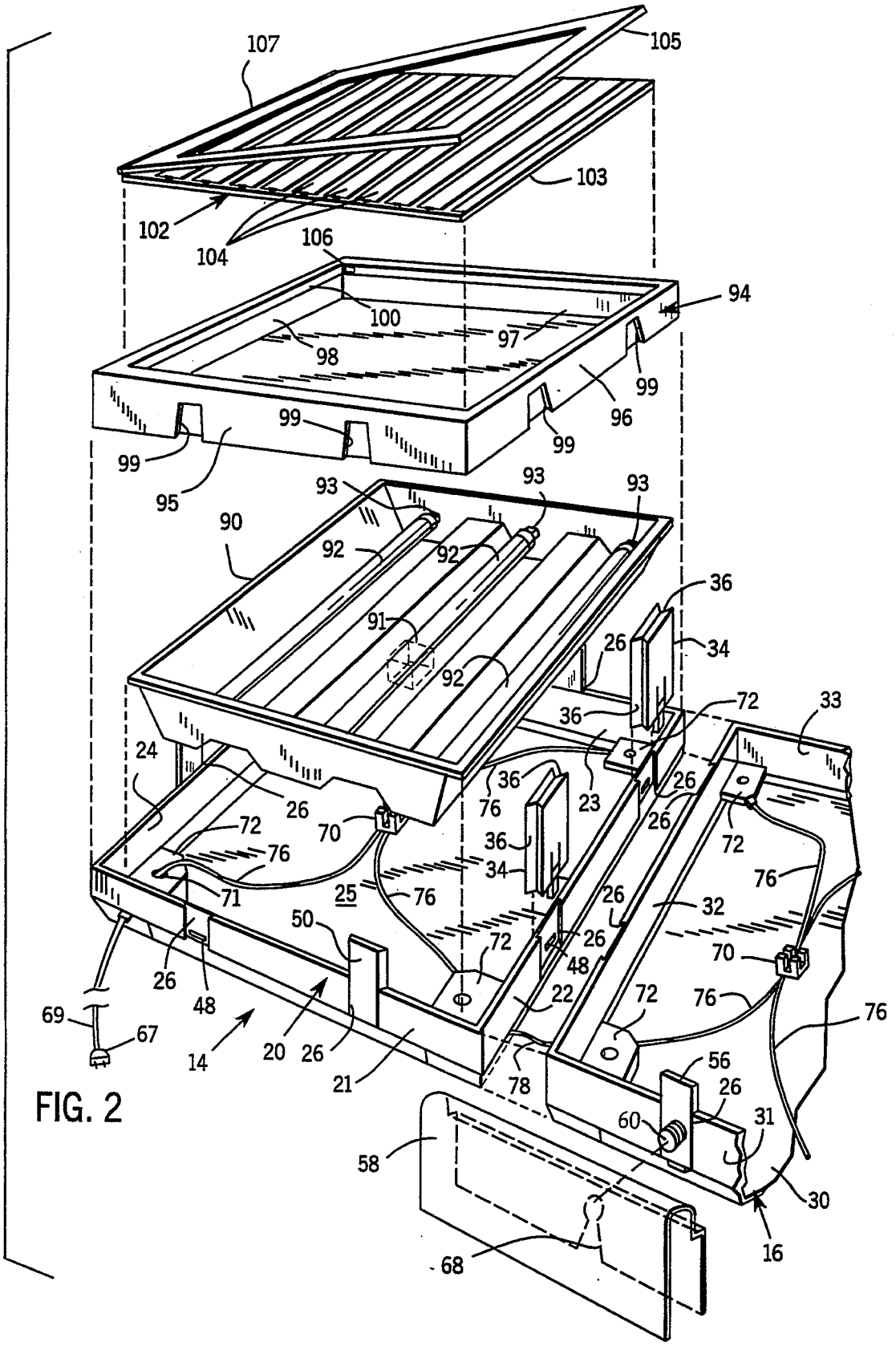
FIG. 2 is an exploded view of one of the modules in the sign of FIG. 1.

With initial reference to FIG. 1, a sign assembly 10, such as is used to display a menu in a fast food restaurant, comprises a member of modules 12, 14, 16, and 18 abutting one another. Each module 12–18 has a self contained display area surrounded by a border. The modules are fabricated in two sizes with one size used as modules 14 and 16, and module 18 being one half the size of module 14. The height of the both sized modules is the same and preferably three times the width of the smaller module 18. For example, the width of module 18 is nine inches, the width of module 18 is eighteen inches and their individual heights are twenty-seven inches. This dimensional relationship 9-18-27 allows the two different size modules to be combined in different numbers and horizontal and vertical orientations to form a wide variety of sized and shaped sign assemblies.

In addition to forming a sign by combinations of the two separate modules placed side-by-side, a greater single display area can be formed by combining sections from two modules. Because the widths of the two different sized rectangular modules equals their height, square module 12 is formed using parts of those different modules. For example, parts of a larger size module form the upper section (above the dashed line) in module 12 with the lower portion uses parts of a smaller module. The unique manner in which these two module sections are joined enables a single large square display to be created and appear to be a third size of module. Carrying this concept further, components of two large rectangular modules can be joined to form a much larger rectangular module, and components of more than two modules can be joined to create an even larger single display module.

Although the modules can form a sign assembly by merely abutting them side-by-side, a more attractive assembly is formed by placing a decorative frame 19 around the perimeter of the assembly. The frames are created from standardized linear components having different lengths. In addition, a variety of wood, plastic and metal linear segments can be provided to further individualize a given sign assembly.

Before delving into how the modules are connected side-by-side and their components joined to form larger module, a description of the basic module design will be beneficial.

FIG. 2 illustrates the components of module 14 and the mechanism by which that module is connected to module 16. Module 14 includes a base 20 formed by a flat rectangular rear panel 25 from which extend four walls 21, 22, 23 and 24 to form a box-like base with an open front. The base 20 has a rectangular shape with the ratio of the width formed by walls 20 and 23 to the length formed by walls 22 and 23 being two to three. A number of dovetail grooves 26 are formed at regular intervals along the outer surface of each base wall 21–24. Dovetail grooves are well known in the art and the width of the groove widens going into the wall from the outer surface as shown in greater detail in FIG. 6.

The second module 16 has a similar base 30 with walls 31, 32 and 33. The walls of the base 30 also have dovetail grooves 26 in their outer surfaces and spaced at the same intervals as in base 20.

In order to form sign assembly 10, the two bases 20 and 30 are placed side-by-side. In this orientation, the dovetail grooves 26 in abutting walls 22 and 32 align with one another. This alignment permits a double dovetail union 34 to slide into each pair of aligned dovetail grooves 26 and act as a connector joining bases 20 and 30 together. The longitudinal side walls 36 of each double dovetail union 34 have an inwardly extending V shape which conforms to the tapered walls of the dovetail grooves 26. Thus, when the double dovetail unions 34 are slid into adjacent pairs of grooves 26, the two bases 20 and 30 (and corresponding sign modules 14 and 16) are interlocked. The length of the double dovetail unions 34 is longer than the height of bases 20 and 30 so that the unions extend above the upper edge of walls 22 and 32.

FIGS. 3A and 3B illustrate the details of the double dovetail union 34. Centered along a short edge of the dovetail union on both major surfaces 36 and 38 is a separate flexible finger 40 and 42, respectively. For example, the double dovetail union is made out of a plastic which allows the finger to flex with respect to the main body of the union 34. Approximately midway along the length of each of the fingers 40 and 42 is a rib 44 and 46, respectively.

Typically, the double dovetail union 34 is slid into the aligned pair of dovetail grooves 26 from the rear of bases 20 and 30. In doing so, the user pinches the two fingers 40 and 42 together to retract the ribs 44 and 46 inwardly with respect to the major surfaces 36 and 38. This allows the union 34 to slide through the aligned dovetail grooves 26 in the bases 20 and 30 until the ribs 44 and 46 align with a detent 48 in each groove. When this position is reached, fingers 40 and 42 are released so that the ribs 44 and 46 enter the detents 48. The engagement of the ribs with the detents holds the double dovetail union 34 in place, preventing further sliding along the grooves 26.

Referring specifically to FIG. 2, wall 21 may be exposed to view in the modular sign assembly 10. In such event, the open dovetail grooves 26 in that wall are filled by a single dovetail union 50 to create a relatively smooth edge surface for the module 14. Single dovetail union 50, shown in detail in FIGS. 4A and 4B, is sized to be held in the dovetail groove 26 by friction.

As noted previously, the modular sign assembly 10 may have a decorative frame 19 around its perimeter. When an optional frame 19 is desired, a trim dovetail union 56 are used in place of connect unions 50 to the decorative frame to the exposed edges of each base 20 and 30. As shown in FIGS. 5A and 5B, the trim dovetail union 56 is similar to the single dovetail union 50 with the addition of a post 60 on the exposed major surface. The post 60 has a circular cylindrical shaft 60 extending from the major surface of the union 56. A disk-shaped head 64 is at the remote end of the shaft 62 and a ring 66 is located midway along the shaft 62 between major surface 57 and the head 64. This combination forms a first space in between surface 57 and ring 66 and a second space between ring 66 and head 64. As shown in FIG. 2, a section of the decorative frame 19 has a notch 68 that is adapted to slide into one of the spaces on post 60 and snap over the shaft 62. The post acts as a fastener holding the frame section 58 in place along the edge of the base 30. Only a short section of the entire decorative frame 19 is shown and the trim dovetail unions 56 would also be used to attached the frame 19 to base 20 of module 14.

Referring still to FIG. 2, a box-like connector housing 72 is formed in each corner of the two bases 20 and 30. The sign assembly 10 is supplied with electricity by a cord 69 that extends through a hole 71 in the connector housing 72 at one corner of the base. Each connector housing 72 has a hole and the manufacture selects one of them through which to run the cord 69. The remote end of cord 69 has a plug 67 for a conventional electrical outlet.

As shown in FIG. 5, portions of walls 21 and 22 and base panel 25 at the rear corners of the base 20 are removed to form externally opening cavities 73 of the connector housing 72. An electrical connector 74 is in each cavity 73 attached to a wall of the respective connector housing 72. Pairs of wires 76 extend between the lamp tray connector 70 and the connectors 74 in each housing 72. The combination of the connectors 70 and 74 and wires 76 form an electrical cable assembly for conducting electricity throughout the base.

The second base 30 has a similar cable assembly which does not have an externally extending power cord 69 connected to it. Instead, the second sign module 16 receives electrical power from the first module 14. To accomplish this, a cable 78 extends from a connector 74 in one corner of the first base 20 to a similar connector in a connector housing 72 at a corner of the second base 30. This cable 78 is shown in greater detail in FIG. 6 and has a pair of electrical conductors with plugs 80 at each end. The plugs 80 are inserted into the connector 74 in each of the bases 20 and 30 to convey electricity therebetween. An exterior corner cover 82 closes the cavity 73 providing a finished corner to the base 20.

Notches 84 are provided in the edge of the cover 82 for the cable 78.

The electrical cable assembly in each bases 20 and 30 enables only one module (e.g. 14) of the sign assembly 10 to be externally supplied with electricity. The remaining modules 12, 16 and 18 receive power from the module 14, either directly or in a daisy chain manner. The module which receives power from the external source may be placed at any location in the sign assembly because the corner connectors allow the base cable assemblies to be interconnected electrically regardless of the physical configuration of the sign assembly.

Referring once again to FIG. 2, a lamp tray 70 contains a plurality of standard fluorescent light bulbs 92. Sockets 93 are provided in the light tray 90 to receive the end terminals of each light bulb 92 and a wiring harness and ballast transformers (not shown) are located on the underside of the light tray 90. The underside of the light tray 90 also has an electrical connector 91 which mates connector 70 on the rear panel 25 of the base 20 when the tray is placed into the base 20 between the walls 21–24. The lamp tray 90 is fastened onto the base 20 by a plurality of machine screws (not shown). In order to replace the ballast transformers for the fluorescent lamps 92, the lamp tray 90 may be removed from the base 20. When this occurs, the electricity is disconnected from the lamp tray, thereby preventing accidental shock to the worker servicing the electrical components of the lamp tray 90.

A rectangular bezel 94 has four walls 95, 96, 97 and 98 interconnected to form a central opening 100. The bezel is placed over the lamp tray 90 onto the exposed edges of the base walls 21–24. Closed dovetail grooves 99 are formed in the bezel walls 95–98 and receive the exposed ends of the dovetail unions 34 and 50 projecting from the base 20. In addition to the unions 34 and 50 holding the bezel in place on base 20, machine screws are used to fasten the components.

The bezel 94 holds a display panel 102 that contains the visual message for the sign. For example a sign module 14 for a restaurant can have a photographic image of a food item, or a listing of the menu items and their respective prices. The display panel 102 is back lighted by the light bulbs 92 and a menu display is formed by translucent characters surrounded by an opaque matrix.

One type of a display panel 102 comprises a transparent sign board 103 to which are fastened a plurality of parallel retainers 107 between which the user inserts strips with the lettering for each line of the sign. A hinge 104 is attached along one edge of the sign board 103 and also attaches to a cover 105 which consists of a frame holding a transparent sheet of plastic.

The sign board 103 slides into notches in opening 100 of the bezel 94 which hold the display panel in place when the module 14 is mounted vertically. By sliding the display panel 102 upward and pulling it out, it can be removed from the bezel 98 without unfastening the bezel from the other components of the sign module 14.

The pin of hinge 107 rests within a notch 106 in the bezel allowing the cover 105 to be opened away from the sign board 103 when the display panel 102 is held in bezel 94. This action permits the user to gain access to the lettering strips in order to change the message. The entire display board 102 also can be removed from the bezel 94 to edit the message.

Alternatively, a flat plastic panel containing a permanent message or photographic image can be inserted into the bezel 94 in place of the hinged display panel 102. It will be apparent to one skilled in the art that other forms of panels can be place into the bezel 94 to form different types of displays.

A similar combination of a light tray, bezel and display panel are mounted on the base 30 for the second sign module 16, although those components have not been illustrated in FIG. 2.

In addition to connecting individual modules next to one another, components of two or more modules can be joined to form a large module. As noted previously with respect to FIG. 1, modules 14, 16 and 18 are rectangular having a height which is greater than their width. The height of the modules 16 and 18 are the same. However, the width of module 16 is twice that of module 18 and their combined widths equal their individual heights. This dimensional relationship enables square module 12 to be formed by joining segments of the two different sized rectangular modules.

Figure 7:
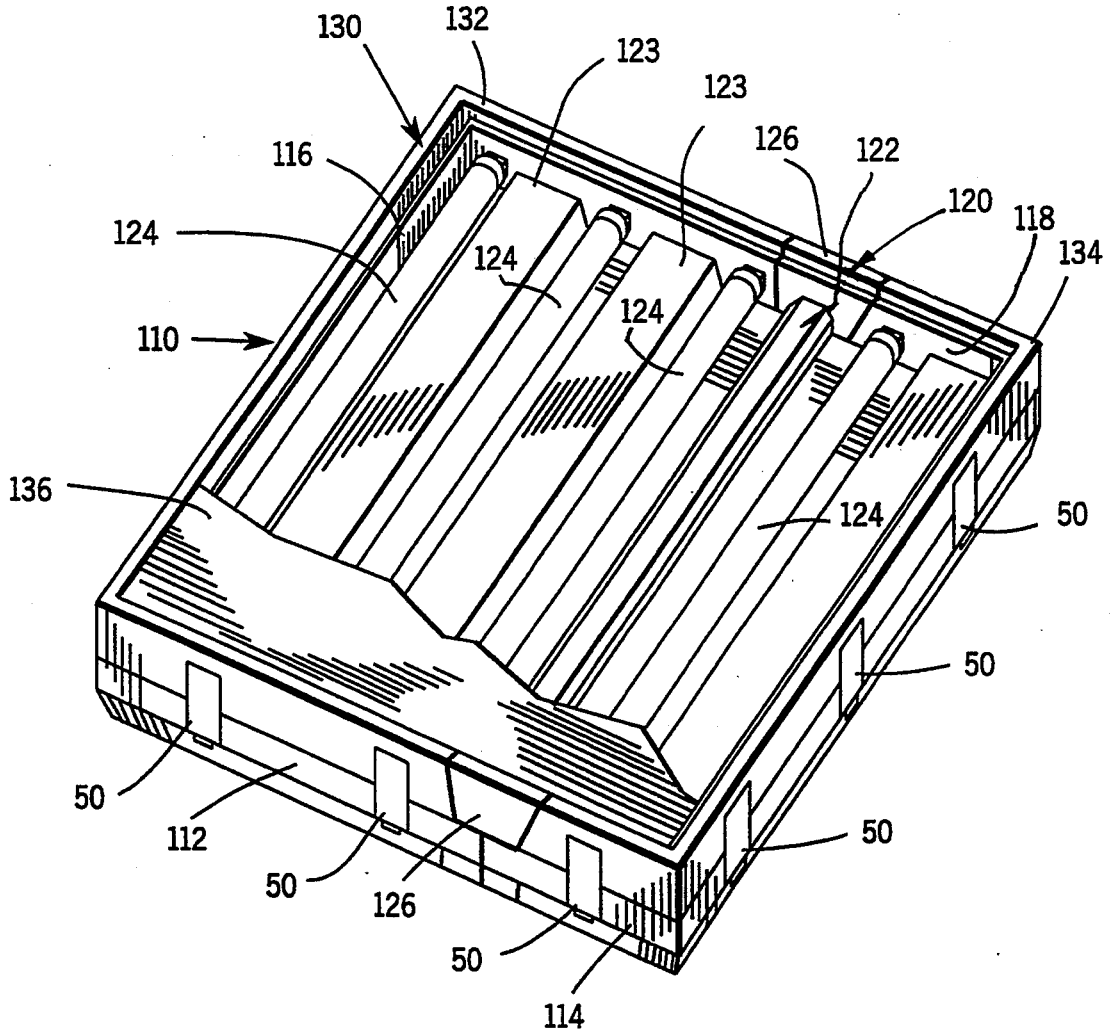
FIG. 7 shows an assembly of two modules in a manner which allows the use of a single enlarged display panel.

With reference to FIG. 7, a base 112, similar to base 20 in FIG. 2, for a larger rectangular module, is placed against a base 114 for the smaller rectangular module. Because the width of the larger module is two-thirds its height and the width of the smaller module is one-thirds its height the combined width of the joined modules equals their height forming a square unit 110. The two bases may be held together by double dovetail unions 34 which are not visible in the illustration of the assembled unit. Conventional single dovetail unions 50 are shown positioned in each of the outer dovetail grooves in decorative frame is to be placed around the square unit 110 trim dovetail unions 56 are used in place of the illustrated unions 50.

Each base 112 and 114 has a wiring assembly similar to that shown in FIG. 2 which includes connectors 74 at each rear corner of the base and a lamp tray connector 70. A connector cable 78, as previously described, connects the wiring assemblies of each base 112 and 116 so that both are electrically powered. When the square unit 110 is used as unit 12, for example, in a sign assembly as shown in FIG. 1, another connector cable 78 provides electrical power from module 14 to module 12 in the same manner as previously described with respect to modules 14 and 16.

Unit 110 is illustrated with the display panel 136 cut away in order to see the lamp trays 116 and 118. Lamp tray 116 is similar to lamp tray 90 in FIG. 2 with one long wall partially adjacent base 114 removed. Similarly, the lamp tray 118 for a smaller rectangular module has a wall removed to form a low interface between the two lamp trays.

A bezel 130 for the square module subassembly 110 comprises bezel portions 132 and 134. Bezel portion 132 similar to bezel 94 (FIG. 2) for the larger rectangular module with one wall 96 removed, thus forming to form a U-shaped bezel. The other bezel portion 134 also has a U-shape and is similar to a bezel for the smaller rectangular module with one wall removed. The bezel portions 132 and 134 are placed over the walls of the correspondingly sized bases 112 and 114 with the ends of the two U-shapes abutting each other.

A joiner element 120 covers the seam between the two different sized module segments and is attached by screws to the two lamp trays 116 and 118 and the two bases 112 and 114 base to further fasten those components together. The joiner element 120 has an elongated rib 122 which covers the seam between the two lamp trays 116 and 118 and forms a light reflector similar to raised ribs 123 between the light bulbs 124 in the larger lamp tray 116. The joiner element 120 also includes end caps 126 at the ends of the rib 122. Each end cap 126 extends over the exposed edge of a bezel 130 covering a gap between the two bezel components 132 and 134. The joiner elements 120 also can be used to connect components from more than two modules to form an even larger module. A single square display panel 136 is inserted into the central opening formed by the combined bezel 130.

Therefore, different sized and shaped sign assemblies can be fabricated not only by abutting the small and large rectangular modules, such as modules 16 and 18, but also by forming square or larger rectangular module units from segments of the basic rectangular modules. One or more square module units can be combined with one or more rectangular modules of different sizes to form the desired sign assembly. It also should be noted that the dovetail grooves 26 on the walls of the modules are spaced at regular intervals in each type of module so that the modules can be attached together in various geometric patterns. In addition,the rectangular modules 16 and 18 may be used vertically as shown in FIG. 1 or horizontally, providing even greater dimensional possibilities to the sign assembly.

I claim:

1. A sign module comprising:

a base having a plurality of interconnected walls with each wall having at least one dovetail groove in an exterior surface;

a plurality of dovetail unions with each one positioned in a dovetail groove in said base;

a lamp tray containing a light bulb and located within walls of said base; and a bezel extending over said lamp tray and having a plurality of dovetail grooves each of which receiving one of said plurality of dovetail unions.

2. The sign module as recited in claim 1 wherein at least some of said plurality of dovetail unions have a fastener extending outwardly therefrom; and further comprising a trim member attached to the fastener.

3. The sign module as recited in claim 1 wherein at least some of said plurality of dovetail unions have a post extending outwardly therefrom; and further comprising a trim member with a notch that engages the post of a dovetail union.

4. The sign module as recited in claim 1 further comprising display panel positioned in said bezel and including a display board for a visual message with the display board attached by a hinge to a transparent cover.

5. A modular sign assembly comprising:

a first module and a second module each including a base having a back panel and a plurality of walls projecting from the back panel, wherein each one of the plurality of walls has at least one dovetail groove in an exterior surface, each of said first and second modules also having a display panel and a light bulb within the base for back lighting the display panel, and wherein one of the plurality of walls of said first module abuts one of the plurality of walls of said second module; and a double dovetail union engaging dovetail grooves in each abutting wall of said first and second modules to hold those modules together.

6. The modular sign assembly as recited in claim 5 further comprising an electrical cable assembly extending between said first and second modules to supply electricity to the light bulb in one of those modules.

7. The modular sign assembly as recited in claim 5 wherein each of said first and second modules further comprises:

a lamp tray containing the light bulb and located within the plurality of walls of said base; and a bezel attached to said base and extending over said lamp tray, with the display panel engaging said bezel.

8. The modular sign assembly as recited in claim 7 wherein said base further comprises a plurality of electrical connectors positioned along walls of the base, and conductors which electrically couple together the plurality of electrical connectors in the module; and further comprising a cable extending between connectors of said first and second modules.

9. The modular sign assembly as recited in claim 8 wherein each one of the plurality of electrical connectors is located adjacent a different intersection of two walls.

10. The modular sign assembly as recited in claim 8 wherein:

said base further comprises a lamp tray connector electrically connected to the plurality of electrical connectors; and said lamp tray includes another connector engaging said lamp tray connector and electrically connected to the light bulb.

11. The modular sign assembly as recited in claim 7 wherein said display panel comprises a display board for containing a visual message, a transparent cover, and a hinge attaching said display panel to said transparent cover.

12. The modular sign assembly as recited in claim 7 wherein said display panel comprises a display board having a plurality of retainer strips attached thereto for holding letters that form a message.

13. The modular sign assembly as recited in claim 5 wherein said first module has a width of N units and a length of three times N units; and said second module has a width of two times N units and a length of three times N units.

14. The modular sign assembly as recited in claim 5 wherein each of plurality of walls of said first and second modules has a plurality of regularly spaced dovetail grooves in the exterior surface.

15. A sign module comprising:

a first segment including a first base with first, second, third and fourth walls connected to form a rectangle, a first lamp tray containing a light bulb and located within the walls of the first base, and a first U-shaped bezel attached to the first, second and third walls of the first base;

a second segment including a second base with fifth, sixth, seventh and eighth walls connected to form a rectangle with the eighth wall abutting the fourth wall of the first base, a second lamp tray containing a light bulb and located within the walls of the base, and a second U-shaped bezel attached to the fifth, sixth and seventh walls of the second base;

a joiner element having a first end cap extending between one end of the first U-shaped bezel and one end of the second U-shaped bezel, second end cap extending between another end of the first U-shaped bezel and another end of the second U-shaped bezel, and a rib connected between the first and second end caps and positioned over a seam between the first and second lamp trays; and a display panel located in the first and second bezels and adjacent said first and second lamp trays.

16. The sign module as recited in claim 15 wherein:

the first, second and third walls of the first base each has a plurality of dovetail grooves in an exterior surface;

the first bezel has a plurality of dovetail grooves each being aligned with a dovetail groove in the first base;

the fifth, sixth and seventh walls of the second base each has a plurality of dovetail grooves in an exterior surface;

the second bezel has a plurality of dovetail grooves each being aligned with a dovetail groove in the second base; and further comprising:

a plurality of dovetail unions with each one located in a dovetail groove in one of said first and second bases and extending into a dovetail groove in one of said first and second bezels.

17. The sign module as recited in claim 15 wherein each of said fourth and eight walls has a plurality of dovetail groove; and further comprising a plurality of double dovetail unions with each one located in a dovetail groove in both of said first and second bases.

18. The sign module as recited in claim 15 wherein each of said first and second bases has an electrical connector adjacent each one of a plurality of intersections of a pair of walls, a lamp tray connector engaging a connector on one of said first and second lamp trays and cables connecting the electrical connectors and lamp tray connector together; and further comprising a cable connecting an electrical connector of said first base to an electrical connector of said second base.

19. The modular sign assembly as recited in claim 15 wherein said first segment has a width of N units and a length of three times N units; and said second segment has a width of two times N units and a length of three times N units.

* * * * *